US005944090A

United States Patent [19]

Teal

[11] Patent Number: 5,944,090

[45] Date of Patent: Aug. 31, 1999

[54] HEAT EXCHANGER FOR FURNACE FLUE

[76] Inventor: William J. Teal, P.O. Box 1804, Dade City, Fla. 33526

[21] Appl. No.: 09/016,410

[22] Filed: Jan. 30, 1998

[51] Int. Cl.[6] ..... F24H 3/08

[52] U.S. Cl. ..... 165/47; 165/901

[58] Field of Search ..... 165/158, 901, 165/47

[56] References Cited

U.S. PATENT DOCUMENTS

| | | | |
|---|---|---|---|
| 2,355,495 | 8/1944 | Zier, Jr. . | |
| 4,158,439 | 6/1979 | Gibbs . | |
| 4,160,524 | 7/1979 | Stiber . | |
| 4,219,073 | 8/1980 | Talmadge et al. | 165/901 X |
| 4,232,732 | 11/1980 | Johnson | 165/901 X |
| 4,313,562 | 2/1982 | White | 165/901 X |
| 4,342,359 | 8/1982 | Baker | 165/901 X |
| 4,455,994 | 6/1984 | Homolik . | |
| 4,469,276 | 9/1984 | Marcum . | |
| 4,550,772 | 11/1985 | Knoch | 165/901 X |
| 4,699,315 | 10/1987 | White . | |
| 4,739,826 | 4/1988 | Michelfelder et al. | 165/901 X |
| 4,854,381 | 8/1989 | Mikula | 165/901 X |
| 5,385,299 | 1/1995 | Zawada . | |
| 5,417,278 | 5/1995 | Pipher et al. | 165/901 X |
| 5,423,374 | 6/1995 | Miller et al. . | |

FOREIGN PATENT DOCUMENTS

| | | | |
|---|---|---|---|
| 198986 | 12/1982 | Japan | 165/901 |
| 775528 | 10/1980 | U.S.S.R. | 165/901 |

*Primary Examiner*—Leonard Leo
*Attorney, Agent, or Firm*—Richard C. Litman

[57] ABSTRACT

A heat exchanger for a furnace flue comprises an outer flue jacket having a plurality of axially parallel exhaust gas passages therethrough. The exhaust gas passage tubes are sealed from the remainder of the interior volume of the jacket by a baffle plate at each end thereof. The outer flue jacket is preferably of the same diameter as the flue pipe in the remainder of the system, e. g., six or eight inches, in order to preclude any requirement for adapters. An inlet pipe and an outlet pipe are affixed to opposite ends of the jacket, at some angle (e. g., normal) thereto. Exhaust gases from the furnace pass through the plurality of pipes within the outer jacket, heating the pipes. Airflow within the jacket and outside the pipes, is warmed by contact with the pipes, and flows from the outlet end to be used for warming the interior of the structure in which the unit is installed. A fan may be provided at either the inlet or outlet pipe, preferably at the inlet, to force air through the jacket and around the internal pipes. The fan may be a constant speed unit, or may include a variable speed control, and may be actuated by a parallel circuit to the main furnace blower motor, or by a separate thermostat. Preferably, the rate of flow of air provided by the fan is at least approximately equal to the rate of flow of exhaust gases through the flue, for optimum heat transfer.

12 Claims, 4 Drawing Sheets

HEAT EXCHANGER FOR FURNACE FLUE

BACKGROUND OF THE INVENTION

1. Field Of The Invention

The present invention relates generally to heat exchanging devices, radiators, and the like, and more specifically to an air-to-air heat exchanger for installing concentrically in line in a furnace flue.

2. Description Of The Related Art

It has long been recognized that heating a space by means of radiant heat (e. g., fireplace) is relatively inefficient, as most of the heat is lost through the chimney. While improvements have been made over the years, such heating systems, particularly where built into a wall where only a single opening in the wall provides heat for the entire room or space, are still relatively inefficient in comparison to modern central heating systems which heat the air itself and circulate the warm air through the structure by means of forced air or convective flow.

Nevertheless, such systems are still open to improvement, in that much of the heat developed in the system is lost through the furnace flue with the furnace exhaust gases. This is true with oil, natural or other gas, or other types of air circulation type heating systems.

Others have recognized this problem in the past, but solutions developed to this point have generally been directed to the recovery of additional heat from fireplace and chimney systems, rather than from air circulation heating or furnace systems. Those which have been developed for such heated air circulation systems, have not proven to be particularly efficient in terms of heat recovery from the furnace flue.

Accordingly, a need will be seen for a furnace flue heat exchanger or heat recovery system which is capable of recovering a large percentage of the heat of the furnace exhaust gases as they travel through the flue. The heat exchanger includes a plurality of relatively smaller pipes or tubes therein, axially parallel to the flue pipe in which they are installed. Furnace exhaust gases travel through the smaller pipes, with ambient air being forced through the remainder of the flue and about the outer surfaces of the smaller pipes, to be heated by the relatively hotter pipes carrying the flue gases.

The present device may be installed concentrically, in line in an existing furnace flue, either singly or plurally, and in either vertical, horizontal, or other orientation. A blower fan is provided, which may be actuated with the furnace blower motor, or by separate thermostatic means, as desired.

A discussion of the related art of which the present inventor is aware, and its differences and distinctions from the present invention, is provided below.

U.S. Pat. No. 2,355,495 issued on Aug. 8, 1944 to Edward M. Zier, Jr., titled "Heating And Air Conditioning System," describes a central heating system with which a below ground air reservoir is provided. Air is drawn from the below ground reservoir to be circulated about the furnace in winter. As the air from the below ground reservoir is warmer than ambient exterior air, less energy is required to heat the air from the below ground reservoir to the desired temperature. The air of the reservoir is relatively cooler than outdoor ambient in the summer, and is used for cooling during that season. However, Zier, Jr. does not disclose a heat exchanger which is installed concentrically in series with an existing flue pipe, as provided by the present invention.

U.S. Pat. No. 4,158,439 issued on Jun. 19, 1979 to John W. Gibbs, titled "Chimney Waste Heat Collector Requiring No Building Renovation," describes a system in which a series of units are stacked within a vertical chimney, and form a closed loop. Liquid is circulated through the units, to capture heat rising upwardly through the chimney. The system differs from the present heat exchanger, in that (1) the present system is not a closed loop system; (2) the present system is an air-to-air exchanger, and does not use a liquid; (3) the present system installs in-line in an existing furnace exhaust flue, rather than being installed within the existing flue pipe or chimney; and (4) the present system uses a series of axially parallel pipes within a larger flue pipe, with the smaller pipes serving as passages for the exhaust gas.

U.S. Pat. No. 4,160,524 issued on Jul. 10, 1979 to Clifford W. Stiber, titled "Circulating Fireplace With Adjustable Controls For Selectively Heating One Or More Rooms," describes a system having a passage concentrically formed about the firebox and chimney of a fireplace, to absorb heat therefrom. Air flows through the passage surrounding the chimney and firebox, and is selectively forced through ductwork to warm the room or rooms of the structure. (No fan is disclosed, but some means of forcing the air through the passageways would be required.) No heat exchanger installed in series with an existing flue pipe is disclosed by Stiber, as provided by the present invention. Also, Stiber does not provide an exhaust gas passage comprising a series of axially parallel pipes or tubes through a section of the flue or chimney, about which air is warmed for heating the structure, as provided by the present invention.

U.S. Pat. No. 4,455,994 issued on Jun. 26, 1984 to Matthew W. Homolik, titled "Woodburning Heating Stove And Heat Extractor," describes an air to air heat exchanger built into the back and upper portions of a woodburning stove. Various embodiments are disclosed, some of which include a plurality of either vertical or horizontal pipes within the heat exchanging unit. However, in each of these embodiments, the stove gases pass around the outside of the pipes, with air being heated by passing through the pipes, which arrangement is exactly opposite the present construction. Moreover, the Homolik system cannot be installed into an existing furnace flue, as provided by the present invention.

U.S. Pat. No. 4,469,276 issued on Sep. 4, 1984 to Al Marcum, titled "Heat Recovery Apparatus," describes a system somewhat like that of the Gibbs '439 U.S. patent described further above. Marcum provides one or more tubes extending vertically up a chimney, and a separate flue for exhausting combustion gases from the fireplace. Air is circulated up the tubes and passes downwardly between the tubes and the flue within the chimney, whereupon it is circulated into the room. The Marcum system cannot be installed in series with an existing furnace flue, as provided by the present invention, nor does Marcum provide a series of parallel exhaust gas passages within a larger passage, with air being heated by circulating about the series of exhaust gas passages, as provided by the present invention.

U.S. Pat. No. 4,699,315 issued on Oct. 13, 1987 to E. R. White, titled "Apparatus For Recovering Chimney Heat," describes a system somewhat similar to that of the Zier, Jr. '495 U.S. patent discussed further above. White provides inlet and return lines disposed exteriorly of the structure, which connect to a chimney cap. The working fluid circulating through these lines, receives heat from the fireplace gases rising from the chimney. The heated fluid is deposited in an underground storage tank for temperature maintenance and later recovery as desired, or passed directly to a forced air heating system to warm the air passing therethrough. The White system cannot be incorporated within the combustion gas flue of a forced air furnace or the like, as provided by the present invention.

U.S. Pat. No. 5,385,299 issued on Jan. 31, 1995 to Michael E. Zawada, titled "Fresh Air Intake System For A Dwelling Having Central Forced Warm Air Heating, " describes a system drawing exterior air into the cold air return duct of the heating system. The cold air is passed about a section of the furnace exhaust heater pipe, to be warmed before being drawn into the return duct. Zawada relies upon the main blower motor of the furnace to draw the air through his system, and uses it only to provide some fresh air into the interior of the structure. The Zawada pre-heater unit relies upon a heat muff surrounding the flue pipe, somewhat like a heater unit for air cooled automobile or aircraft engines, rather than circulating the air about a series of exhaust pipes passing through a larger flue pipe, as in the present invention.

Finally, U.S. Pat. No. 5,423,374 issued on Jun. 13, 1995 to Henry J. Miller et al., titled "Heat Exchanger For Flue Gas," describes a device which is installed in line with the flue of a stove, furnace or the like. However, Miller et al. require a larger diameter section of flue pipe, which must be assembled with reducers to the flue sections immediately preceding and following their heat exchanger. Moreover, Miller et al. use only two relatively large pipes within their larger diameter flue pipe. This is because they use the internal pipes for the circulation of room air, with the larger diameter flue pipe containing the flue gases which are routed about the exteriors of the internal pipes. Miller et al. do not provide any forced air means, thus requiring relatively large diameter pipes, unlike the present invention. In the present invention, flow is opposite that of the Miller et al. device, in that flue gases pass through the internal pipes within the flue, while air within the structure or room is passed about the exterior of the plurality of internal pipes, within the larger diameter pipe. While the present invention could rely upon air flow from the main blower fan, preferably a small fan having a capacity about equal to the furnace exhaust flow, is provided. This has been found to optimize the efficiency of the heat exchange operation in the present invention.

None of the above inventions and patents, taken either singly or in combination, is seen to describe the instant invention as claimed.

SUMMARY OF THE INVENTION

The present invention comprises a heat exchanger for a furnace flue, constructed using a section of flue pipe preferably of equal diameter to the flue pipe of the furnace installation with which the present invention is installed. The present heat exchanger includes a series of relatively small diameter pipes therein, with each end of the larger pipe or jacket being capped and sealed by a baffle plate. The smaller diameter pipes are sealed to and extend through the baffle plate, with furnace exhaust gases thus passing through the interiors of the smaller pipes to travel through the heat exchanger. The interior volume of the heat exchanger jacket disposed exteriorly of the smaller diameter pipes, is thus devoid of all furnace exhaust gases.

An entry pipe or tube is sealed to the heat exchanger adjacent one end and at an angle thereto, with an opposite outlet pipe or tube being sealed to the exchanger adjacent the opposite end at an angle thereto. One of these two pipes (preferably the entry pipe) may include a fan therein. The fan draws air through the entry pipe and through the outer flue jacket surrounding the smaller interior tubes, whereupon the air is heated by contact with the plurality of tubes within the outer jacket. The heated air then exits the jacket at the exit pipe, and is used to warm the interior of the structure in which the system is installed. The fan may be activated by the same circuitry as the main blower motor, or by a separate thermostat in the flue pipe, as desired. A series of such units may be installed along a furnace flue, if so desired. Also, the inlet air for the system may be taken from the return air duct of the central system, with warmed outlet air from the system being transferred to the ductwork of the central system, if so desired.

Accordingly, it is a principal object of the invention to provide an improved heat exchanger for a furnace flue, for in-line installation in an existing furnace exhaust gas flue, for capturing heat from the exhaust flue and warming air within the structure in which the furnace is installed.

It is another object of the invention to provide an improved heat exchanger for a furnace flue, comprising a plurality of exhaust gas ducts or pipes disposed axially parallel to and within an outer flue jacket, with the interiors of the pipes being sealed from the remaining volume of the jacket interior.

It is a further object of the invention to provide an improved heat exchanger for a furnace flue, which plural pipes provide for the flow of furnace exhaust gas therethrough, with ambient interior air being circulated about the exteriors of the exhaust gas pipes and within the outer jacket.

An additional object of the invention is to provide an improved heat exchanger for a furnace flue, including an inlet pipe and an opposite outlet pipe each communicating with the interior of the outer flue jacket, with a fan disposed within the inlet pipe to force air through the system.

Still another object of the invention is to provide an improved heat exchanger for a furnace flue, in which two or more such units may be installed in series with one another for further heat recovery.

Yet another object of the invention is to provide an improved heat exchanger for a furnace flue, which fan means may comprise a variable speed fan, and which preferably provides a rate of flow of air through the flue jacket which is at least approximately equal to the rate of flow of flue gases passing through the interior pipes or tubes.

It is an object of the invention to provide improved elements and arrangements thereof in an apparatus for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a heat exchanger installable in line in a new or existing furnace exhaust gas flue. The device is dimensioned to fit the existing flue pipe diameters (normally six or eight inches), without requiring any form of reducers, adapters, or other specialized fittings, and is thus easily installed to capture otherwise lost heat from a furnace flue.

Figure 1:
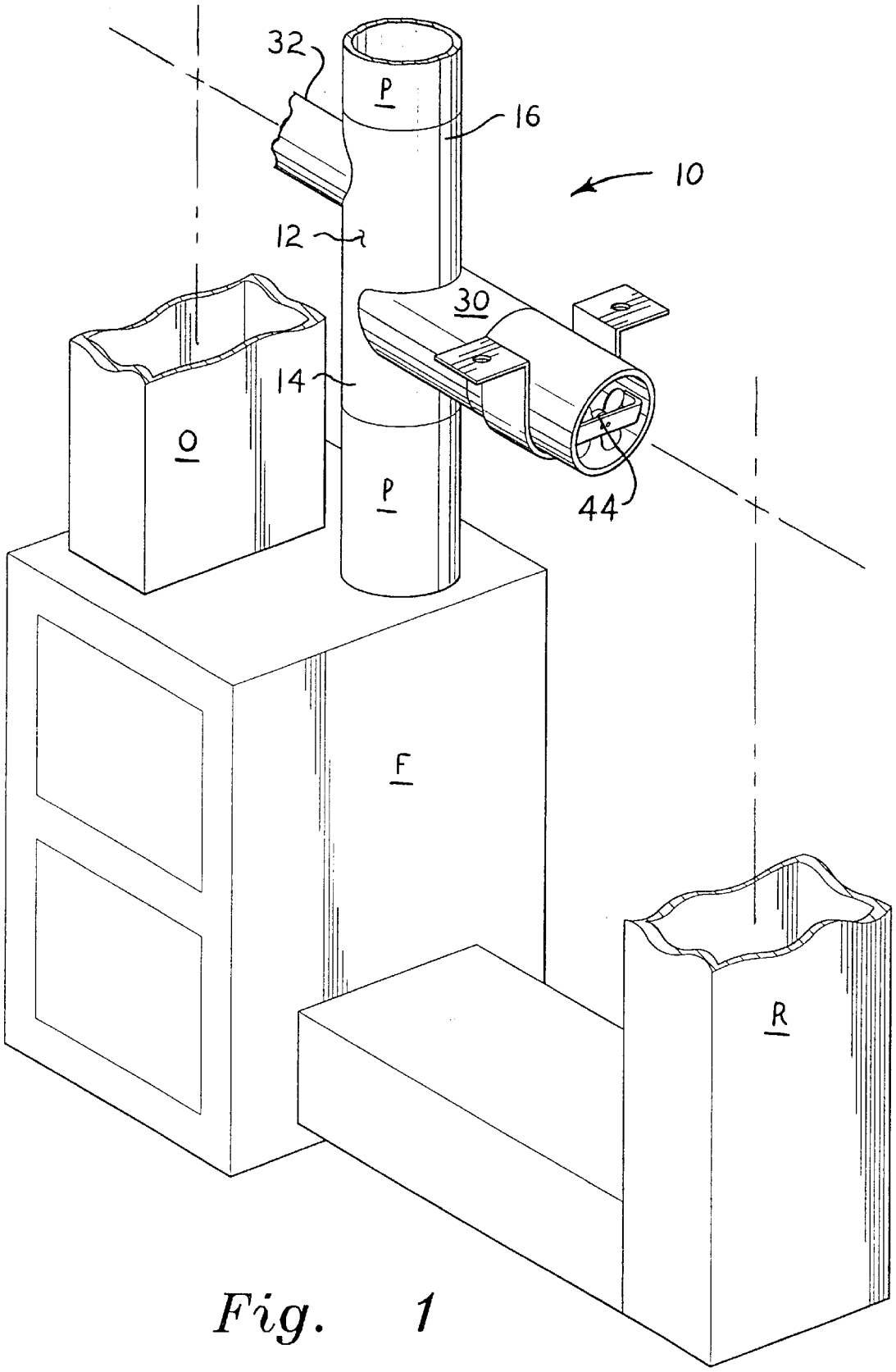
FIG. 1 is an broken away environmental perspective view, showing the present heat exchanger installed in the exhaust gas flue of a furnace.
Figure 3:
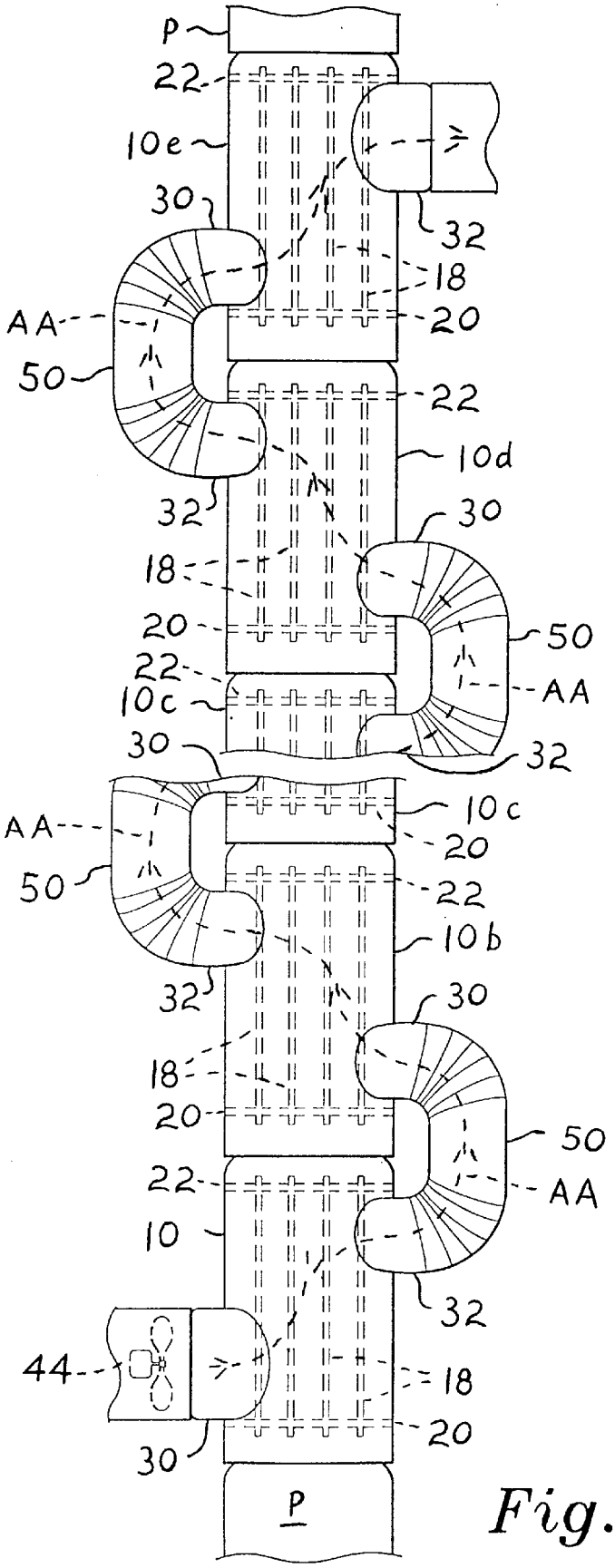
FIG. 3 is an elevation view of an alternate embodiment of the present invention, showing a plurality of heat exchangers arranged in series, with an inlet unit at the bottom, an outlet unit at the top, and a series of intermediate units therebetween.

FIG. 1 provides a perspective view of a typical installation of a single heat exchanger unit 10 of the present invention. The unit 10 is installed concentrically in series with the flue pipe P of a furnace F, with exhaust gases from the furnace F passing through the heat exchanger unit 10 as they pass through the flue pipe P to exit the structure. A single such heat exchanger unit 10 may be installed in series in the flue pipe P, as shown in FIG. 1, or two or more such units may be installed in series with one another and in line with the furnace flue, as shown in FIG. 3 and discussed further below.

Figure 2:
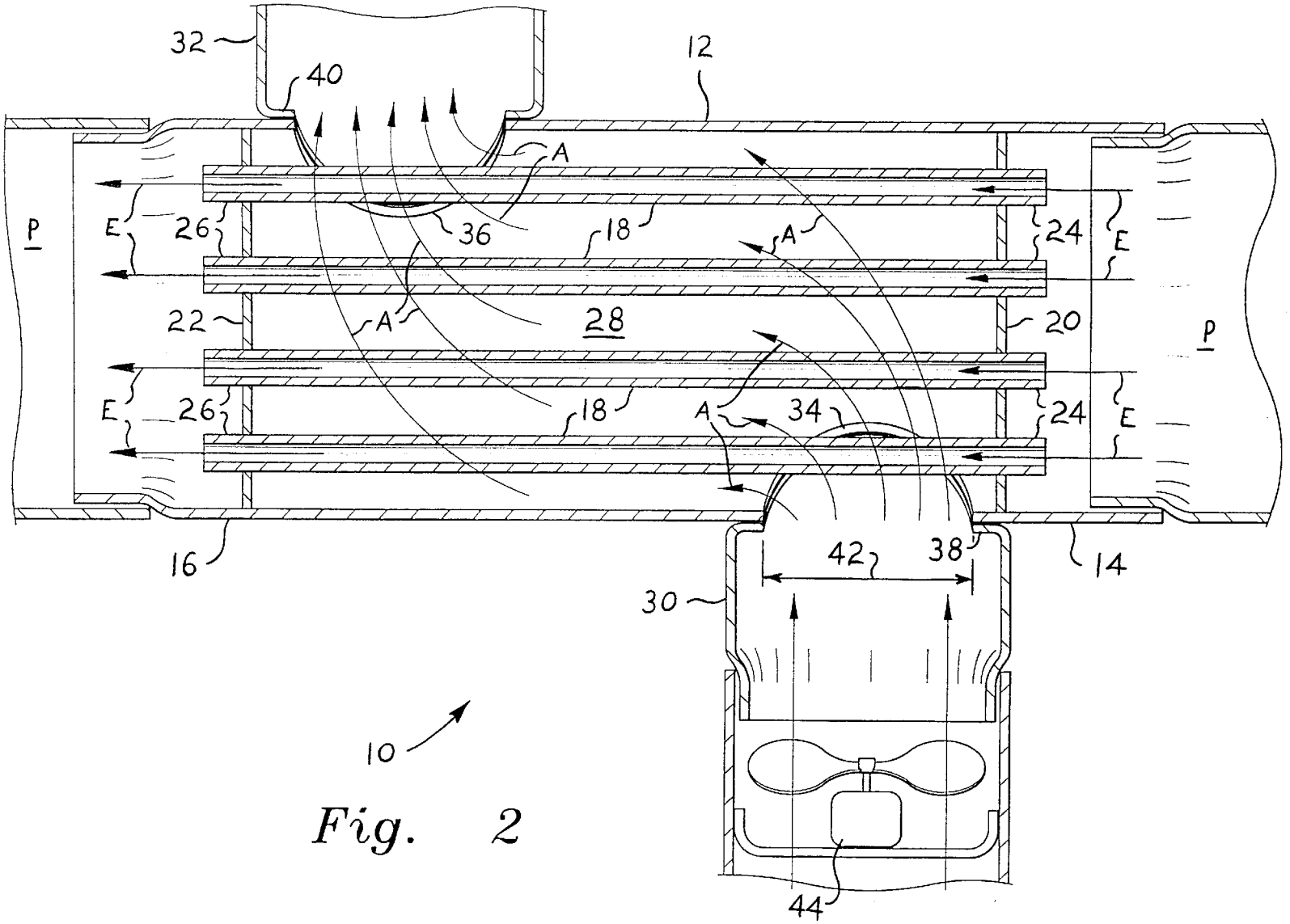
FIG. 2 is an elevation view in section of the present heat exchanger, showing various details thereof and the air and gas flow therethrough.

FIG. 2 provides a detailed view in section of the present heat exchanger 10. The device comprises an outer jacket 12 formed of a standard length of flue pipe, and having a first end 14 and an opposite second end 16. A plurality (preferably fourteen, evenly spaced) furnace exhaust gas tubes 18 are installed within the outer jacket, axially parallel with one another, as shown. (Only four such tubes 18 are shown in FIG. 1, due to the nature of the sectional view and for clarity in the drawing figure.) The tubes 18 are secured in place within the outer jacket 12 by a first and an opposite second baffle plate, respectively 20 and 22, installed within the respective first and second ends 14 and 16 of the outer jacket 12. Each of the tubes 18 has a first end 24 and an opposite second end 26, extending respectively through the first and second baffle plates 20 and 22. The tubes 18, baffles 20 and 22, and outer jacket 12 are preferably sealed to one another by a gas tight fit by brazing, in order to withstand the heat developed in the flue.

The interior of the outer jacket 12 between the two baffle plates 20 and 22 (excepting the volume taken up by the exhaust gas tubes 18), defines an air warming plenum 28 within the outer jacket 12. As the two baffle plates 20 and 22 are sealed within the two ends 14 and 16 of the outer jacket 12, and the tubes 18 are sealed about their ends 24 and 26 which pass through passages in baffle plates 20 and 22, exhaust gases (represented by the arrows E in FIG. 2) cannot pass from the tubes 18 (or from the outside of the baffles 20 and 22), into the air warming plenum 28 of the unit 10.

Each unit 10 includes an inlet pipe 30 and an outlet pipe 32, respectively sealed (e. g., brazed, although other attachment means may be used alternatively for all components, so long as all joints are gas tight) to or adjacent to the first and second ends 14 and 16 of the outer jacket 12. These pipes 30 and 32 extend at some angle (e. g., normal, as shown in the drawings, although an acute angle may be used) to the elongate axes of the outer jacket 12 and pipes 18. An inlet and an outlet opening, respectively 34 and 36, are formed through the outer jacket 12 wall, thereby allowing the pipes 30 and 32 to communicate with the plenum 28 of the unit 10, and air (represented by the arrows A) to flow from the inlet pipe 30, through the plenum 28, and out of the unit through the outlet pipe 32. Air A entering the inlet pipe 30 and passing generally parallel to the exhaust gas pipes 18 and thence out the outlet pipe 32, cannot mix with any exhaust air E due to the sealing of the pipes 18 where they pass through the baffles 20 and 22, and the sealing of the baffles 20 and 22 to the interior of the jacket 12.

The inlet and outlet pipes 30 and 32 each have an attachment flange, respectively 38 and 40, which provide a relatively large mating area or surface between the pipes 30, 32 and the outer surface of the jacket 12 for sealing these components to one another. Preferably, the attachment flanges 38 and 40 are turned or bent inwardly. The openings or passages formed through the wall of the outer jacket 12 are preferably substantially equal in diameter to the diameter 42 of the opening defined by the inwardly turned flanges 38 and 40, respectively of the inlet and outlet pipes 30 and 32. This slightly smaller diameter 42 of the openings formed through the wall of the outer jacket 12, reduces the amount of material removed from the outer jacket 12 and thus provides somewhat greater strength for the outer jacket 12.

While FIG. 1 shows a heat exchanger unit 10 being installed generally vertically within a generally vertical run of flue pipe P, FIG. 2 shows such a heat exchanger unit 10 disposed generally horizontally. It will be seen that the specific orientation of the present invention is not critical, particularly when provided with some means of forcing airflow through the air warming plenum 28 of the unit 10. Accordingly, an electric fan 44 may be provided to force air A through the inlet pipe 30 and air warming plenum 28, and out the outlet pipe 32. While the drawing figures show the fan 44 as installed with the inlet pipe 30, it will be seen that the fan 44 could be installed at the outlet pipe 32, to draw air through the unit 10, if desired. Also, while an axial flow fan is shown, other types of fans (e. g., radial flow) may be used.

It should be noted that the capacity of the fan 44 is important to optimizing the efficiency of the present heat exchanger 10. If the fan capacity (i. e., cubic feet per minute of airflow) is too high, the air A will pass through the air warming plenum 28 of the unit 10 too quickly, and will not absorb sufficient heat from the tubes 24. On the other hand, if the capacity of the fan 44 is too low, then an insufficient volume of air will be moved through the exchanger 10 to provide any significant amount of warm air at the outlet pipe 32. It has been found that optimally, the fan 44 capacity should closely approximate the rate of flow of exhaust gases through the flue pipe P (and thus through the tubes 18). Thus, if the exhaust gas flow is e. g., on the order of ten cubic feet per minute (cfm), then the fan 44 preferably has about the same air movement capacity. (The above figures are exemplary, and other numbers may be more representative of actual installations. The critical point is that the fan 44 provide a rate of air flow closely approximating the rate of flow of exhaust gases, regardless of the actual rates.)

Figure 5:
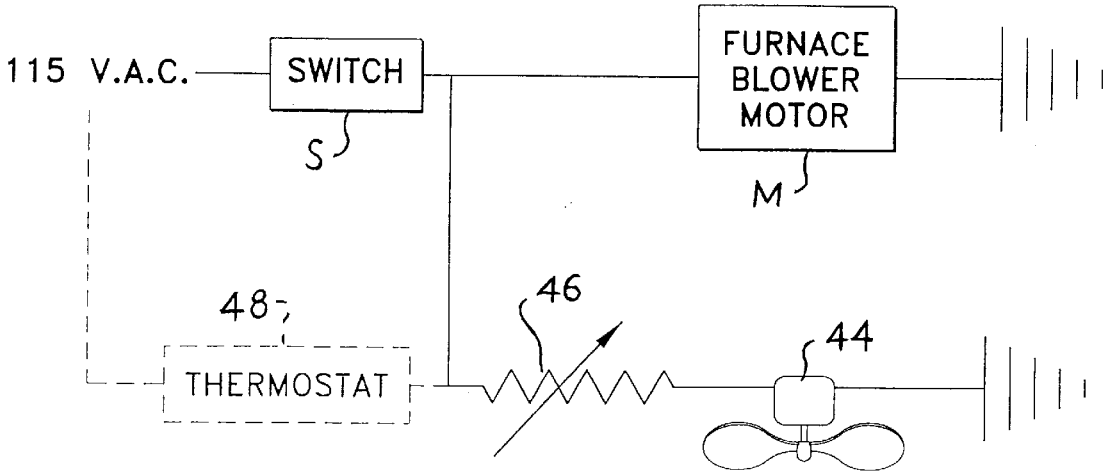
FIG. 5 is an electrical schematic diagram of the present heat exchanger fan means and electrical power therefor.

Accordingly, the fan 44 may be provided with a variable speed control 46, as shown schematically by the variable resistor or rheostat symbol 46 in FIG. 5. The variable speed control 46 allows the fan 44 speed to be adjusted as desired for optimum efficiency of the heat exchanger unit 10, as desired, whatever the exhaust gas flow rate may be through the exhaust gas tubes 18 within the heat exchanger unit 10.

Preferably, the electric fan 44 is wired in parallel with the main blower motor M for the furnace F, as indicated schematically in FIG. 5. Thus, when the thermostat switch S and relay are closed to activate the furnace blower motor M, electrical current will also flow to the heat exchanger fan 44, to operate that fan 44. As the main blower motor M is normally operating only when the furnace is actually burning fuel to produce heat (with some delay in activation and deactivation possible, depending upon temperature in the furnace plenum) it will be seen that this arrangement causes the heat exchanger fan 44 to operate automatically, generally whenever relatively hot flue gases are passing through the heat exchanger 10.

Alternatively, a separate thermostat control 48 may be provided for the fan 44, as shown optionally in broken lines in FIG. 5. This thermostat 48 may be situated in the exhaust gas flue pipe P of the furnace F, in order to activate the heat exchanger fan 44 only when relatively hot exhaust gases are passing through the flue pipe P and heat exchanger 10. It will be seen that the thermostat 48 may be the same thermostat as used for controlling the furnace F itself, if desired. The fan 44 may also be connected in parallel with the solenoid which operates the fuel (oil or gas) valve for the furnace F, so that the fan 44 is operating whenever fuel is being provided to produce heat.

It was noted above, that preferably the rate of flow of air A through the plenum 28 of the heat exchanger 10, is substantially equal to the rate of flow of exhaust gases F through the exhaust gas tubes 18 of the device. However, it should also be noted that the ratio of the size and number of tubes 18 to the internal cross sectional area of the heat exchanger 10, is also important. If the number or diameter of the tubes 18 is too small, then the exhaust gas flow is restricted, and relatively little heat is transferred from the tubes 18 to the air A flowing through the plenum 28. On the other hand, if the tubes 18 are too large or too numerous, then relatively little volume remains in the plenum 28 for airflow therethrough, resulting in relatively little air being heated.

Figure 4:
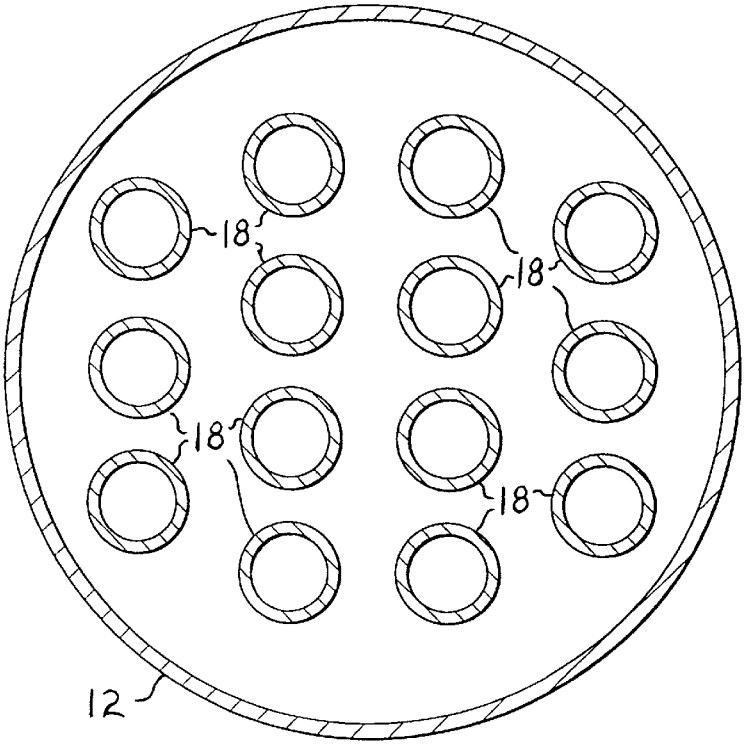
FIG. 4 is a plan view in section of the present heat exchanger, showing the preferred arrangement of the internal exhaust gas passage tubes.

In a heat exchanger outer jacket flue 12 having a diameter of six inches, or a cross sectional area of approximately twenty eight inches, a group of fourteen parallel tubes each having an outer diameter of about one and one eighth inch, or a cross sectional area of about one inch square, works well, as shown in the cross sectional view of FIG. 4. Fourteen such tubes 18 will have a collective cross sectional area of about fourteen inches, or substantially half that of the total cross sectional area of the plenum 28. Thus, the cross sectional area through which the exhaust gases E flow through the tubes 18, is nearly the same as the cross sectional area of the plenum 28 (neglecting the cross sectional area of tubes 18), through which the air A flows. While the number and diameter of tubes 18 may be varied, this ratio of equal cross sectional areas for exhaust gas and airflow, is preferred.

To this point, the discussion of the present heat exchanger 10 has described the installation of only a single such heat exchanger unit 10 in a string of flue pipe P sections, as shown in FIG. 1 of the drawings. However, it will be seen that there is no theoretical limit to the number of such units 10 which may be connected in series, in a flue pipe string. FIG. 3 provides an elevation view of such a series arrangement of plural heat exchanger units 10*a* through 10*e*, in a flue pipe P.

Each of the units 10*a* through 10*e* are substantially identical to one another, with each having an outer jacket or shell and a plurality of exhaust gas tubes 18 therein, sealed in place at each end thereof by first and second baffle plates 20 and 22. Each of the heat exchanger units 10*a* through 10*e* also includes an inlet pipe 30 and outlet pipe 32, at opposite ends of the unit from one another. However, each of the inlet pipes 30 of the intermediate units 10*b*, 10*c*, and 10*d*, and final unit 10*e*, are connected to the outlet pipe 32 of the preceding adjacent unit, by a generally U-shaped connector pipe 50, formed of a pair of elbows and a short connecting segment. Thus, the outlet pipe 32 of the first unit 10*a* connects to the inlet pipe 30 of second unit 10*b*, with outlet pipe 32 of the second unit 10*b* connecting to inlet pipe 30 of the third unit 10*c*, and so forth, with outlet pipe 32 of the fourth unit 10*d* connecting to inlet pipe 30 of the fifth unit 10*e*. Air flows serially through the assembly as indicated by the airflow arrow AA, shown in broken lines through the assembly. Exhaust gas flow is in essentially a straight line through the tubes 18 of each unit.

In summary, the present heat exchanger will be seen to provide a significant savings in heating fuel, by capturing heat otherwise wasted in a furnace exhaust gas flue and using that captured heat to heat the structure. Such heat exchanging units may be installed singly in the flue system of a furnace, as indicated in FIG. 1, or may be installed serially, as indicated in FIG. 3. (While five such units are shown in FIG. 3, it will be understood that more or fewer such units may be assembled together, if desired, and need not necessarily be connected directly to one another, but may include a section of flue pipe between different heat exchanger units, as desired, depending upon the specific configuration of the system.)

The present heat exchanger units are assembled to provide gas tight joints or seals to assure that exhaust gases cannot pass to the air being heated by the units. Brazing of all joints is preferred, for temperature resistance and good sealing, but alternative assembly means may also be used.

Preferably, the cross sectional area of the exhaust gas tubes within each unit is essentially equal to the cross sectional area of the plenum defined by the outer jacket and its opposite baffle plates at each end (less the area of the tubes). This provides optimum heat transfer for air flowing through the plenum. While the tubes may be formed of any practicable material, copper has been found to work well, due to its relatively good heat conductivity. An aluminized coating may be applied to the units, to provide protection from corrosion and good heat conductivity.

Preferably, an electric fan is installed somewhere in the heat exchanger system, preferably at the inlet pipe of the heat exchanger or exchanger assembly. (The fan section may include a mounting bracket, as shown in FIG. 1, to provide a more secure installation.) The fan may be electrically connected to the main blower motor of the furnace, or to thermostat means, for automatic actuation. While FIG. 1 shows the inlet pipe and fan, and opposite outlet pipe, unconnected to other structures, it will be seen that the inlet pipe and fan may draw air from the cold air return duct R of the furnace F, and the warm air outlet pipe may exhaust heated air into the outlet duct O of the furnace F, as indicated by the intersecting centerlines shown in FIG. 1. Thus, the present heat exchanger provides a versatile and economical means of capturing otherwise wasted heat and using such heat to warm the interior of a structure, thus lowering heating costs for the user of the device.

It is to be understood that the present invention is not limited to the embodiments described above, but encompasses any and all embodiments within the scope of the following claims.

I claim:

1. A heat exchanger for a furnace having a furnace flue, comprising:

an outer jacket comprising a length of flue pipe having a first end and an opposite second end, for installing in line to the furnace flue, said outer jacket having a diameter substantially equal to the diameter of the furnace flue;

said outer jacket including a plurality of axially parallel exhaust gas tubes therein, for passing furnace exhaust gases therethrough;

a first and an opposite second baffle plate sealingly affixed respectively within said first and said second end of said outer jacket;

said outer jacket and each said baffle plate defining an air warming plenum therewithin, excepting said exhaust gas tubes;

each of said exhaust gas tubes having a first end and an opposite second end respectively extending through said first and said second baffle plate, and sealed therearound for precluding gas flow past said first and said second baffle plate;

an inlet pipe and an outlet pipe sealingly affixed to said outer jacket respectively adjacent said first end and said second end thereof, with said inlet and said outlet pipe communicating with said plenum within said outer jacket, for passing air around said exhaust gas tubes within said outer jacket and with airflow generally parallel to said exhaust gas tubes, for warming the air passed thereby; and a variable speed electric fan means forcing air through said outer jacket along said exhaust gas tubes for producing a regular flow of air therethrough;

wherein said outer jacket has an internal cross sectional area and said exhaust gas tubes have a collective internal cross sectional area, with said internal cross sectional area of said outer jacket being substantially twice said collective internal cross sectional area of said exhaust gas tubes for heat exchanging an air volume at or about 10 cubic feet per minute.

2. The heat exchanger according to claim 1, wherein said outer jacket has a diameter ranging from six inches to eight inches and corresponding to the diameter of the flue pipe.

3. The heat exchanger according to claim 1, wherein:

said inlet and said outlet pipe each have an outer jacket attachment end with an inwardly turned attachment flange defining a passage diameter;

said outer jacket includes an inlet and an opposite outlet opening therein respectively communicating with said inlet and said outlet pipe, with each said opening having a diameter substantially equal to said passage diameter of said inlet and said outlet pipe.

4. The heat exchanger according to claim 1, wherein said exhaust gas tubes, said first and said second baffle plate, said outer jacket, and said inlet and said outlet pipe are all sealingly affixed by braising.

5. The heat exchanger according to claim 1, wherein said fan means provides a rate of air flow through said outer jacket substantially equal to the rate of gas flow through the furnace flue.

6. The heat exchanger according to claim 5 with the furnace having an electric blower motor and circuitry therefor, with said fan means receiving electric power from the blower motor circuitry and being actuated simultaneously with the furnace blower motor.

7. A heat exchanger for a furnace having a furnace flue, comprising:

a plurality of heat exchanger units each having an outer jacket comprising a length of flue pipe having a first end and an opposite second end, for installing in line to the furnace flue and with one another, wherein said outer jacket of each of said units has a diameter substantially equal to the diameter of the furnace flue;

said outer jacket of each of said units including a plurality of axially parallel exhaust gas tubes therein, for passing furnace exhaust gases therethrough;

a first and an opposite second baffle plate sealingly affixed respectively within said first and said second end of said outer jacket of each of said units;

said outer jacket and each said baffle plate therein defining an air warming plenum therewithin, excepting said exhaust gas tubes, within each of said units;

each of said exhaust gas tubes in each of said units having a first end and an opposite second end respectively extending through said first and said second baffle plate of the respective said unit, and sealed therearound for precluding gas flow past said first and said second baffle plate of said outer jacket of each of said units;

an inlet pipe and an outlet pipe sealingly affixed to said outer jacket respectively adjacent said first end and said second end thereof in each of said units, with said inlet and said outlet pipe communicating with said plenum within the outer jacket of the respective said unit, for passing air around said exhaust gas tubes within said outer jacket of the respective said unit and with airflow generally parallel to said exhaust gas tubes, for warming the air passed thereby;

said outlet pipe of a first one of said units communicating with said inlet pipe of a second one of said units for passing the warmed air serially from said first one of said units to said second one of said units, and continuing in like connective manner throughout said plurality of heat exchanger units; and at least one of said units includes a variable speed electric fan means forcing air through said outer jacket of said at least one of said units and along said exhaust gas tubes therein for producing a regular air flow thereby;

wherein said outer jacket of each of said units has an internal cross sectional area and said exhaust gas tubes of each of said units have a collective internal cross sectional area, with said internal cross sectional area of said outer jacket being substantially twice said collective internal cross sectional area of said exhaust gas tubes for heat exchanging an air volume at or about 10 cubic feet per minute.

8. The heat exchanger according to claim 7, wherein said outer jacket of each of said units has a diameter ranging from six inches to eight inches.

9. The heat exchanger according to claim 7, wherein:

said inlet and said outlet pipe of each of said units each have an outer jacket attachment end with an inwardly turned attachment flange defining a passage diameter;

said outer jacket of each of said units includes an inlet and an opposite outlet opening therein respectively communicating with said inlet and said outlet pipe of the respective one of said units, with each said opening having a diameter substantially equal to said passage diameter of said inlet and said outlet pipe.

10. The heat exchanger according to claim 7, wherein said exhaust gas tubes, said first and said second baffle plate, said outer jacket, and said inlet and said outlet pipe of each of said units are all sealingly affixed by braising.

11. The heat exchanger according to claim 7 wherein said fan means provides a rate of air flow through said outer jacket of each of said units, substantially equal to the rate of gas flow through the furnace flue.

12. The heat exchanger according to claim 11 with the furnace having an electric blower motor and circuitry therefor, with said fan means receiving electric power from the blower motor circuitry and being actuated simultaneously with the furnace blower motor.

* * * * *